United States Patent [19]

Kobus et al.

[11] Patent Number: 5,021,799

[45] Date of Patent: Jun. 4, 1991

[54] HIGH PERMITIVITY DIELECTRIC MICROSTRIP DIPOLE ANTENNA

[75] Inventors: Joseph P. Kobus, Phoenix; Ronald F. Kielmeyer, Jr., Chandler; Arthur Diaz, Scottsdale, all of Ariz.

[73] Assignee: Motorola, Inc., Schaumburg, Ill.

[21] Appl. No.: 374,817

[22] Filed: Jul. 3, 1989

[51] Int. Cl.[5] ..... H01Q 9/28

[52] U.S. Cl. ..... 343/795; 343/818; 343/821

[58] Field of Search ..... 343/700 MS, 795, 821, 343/818

[56] References Cited

FOREIGN PATENT DOCUMENTS

| | | | |
|---|---|---|---|
| 190412 | 8/1986 | European Pat. Off. | 343/700 MS |
| 2811521 | 10/1978 | Fed. Rep. of Germany | 343/821 |
| 81705 | 5/1982 | Japan | 343/700 MS |
| 1387450 | 3/1975 | United Kingdom | 343/821 |

OTHER PUBLICATIONS

Kinzel et al., "V-Band, Space-Based Phase Arrays", Microwave Journal, Jan. 1987, pp. 89, 90, 92, 94, 96, 98, 100, 102.

*Primary Examiner*—Michael C. Wimer

*Attorney, Agent, or Firm*—Frank J. Bogacz; Jordan C. Powell

[57] ABSTRACT

A miniature microstrip dipole antenna is constructed on a high permitivity dielectric substrate for compactibility with microwave monolithic integrated circuit (MMIC) technology. The antenna comprises two dipole arms coupled to opposite faces of the substrate. The dipole arms are coupled to a microstrip transmission line through a tapered balun. The tapered balun comprises two conductors on opposite faces of the substrate which are coupled to corresponding dipole arms. The conductors are separated laterally (with respect to the width of the face of the substrate) a calculated distance, and are gradually tapered. This allows the balun to efficiently transform unbalanced signals at the microstrip transmission line to balanced signals at the plurality of dipole arms. Alternatively, the balun allows balanced signals at the dipole arms to be efficiently transformed to unbalanced signals at the microstrip transmission line. To achieve additional radiation directivity, a ground plane is coupled to and parallel with a back face of the substrate. By using a high dielectric substrate, the cavity formed between the substrate and the ground plane is relatively very shallow.

3 Claims, 1 Drawing Sheet

HIGH PERMITIVITY DIELECTRIC MICROSTRIP DIPOLE ANTENNA

BACKGROUND OF THE INVENTION

This invention relates in general to antennas, and more specifically to microstrip dipole antennas formed on high permitivity dielectric substrates.

Conventional printed-circuit dipole antennas are constructed on low permitivity dielectric substrates. These low permitivity dielectric substrates are relatively thick. Furthermore, the dipoles are relatively large and require large resonant cavities. These large antennas cannot be used directly with monolithic microwave integrated circuits (MMIC), but require additional interconnecting circuitry for MMIC applications.

To decrease the size of the antenna and make it compatible with MMIC technology, the antenna substrate must be reduced in thickness. Additionally, the permitivity of the substrate must be increased. One dipole antenna having a higher permitivity substrate has been designed using a Bawer and Wolfe Balun. This balun couples the two dipole arms to a microstrip transmission line by means of parallel conductors. The conductors form a rectangle having 90 degree corners. The Bawer and Wolfe Balun, however, generates significant amounts of spurious radiation from its resonant transmission line conductors, particularly when formed on relatively high permitivity substrates. The spurious radiation reduces the desired dipole antenna efficiency.

SUMMARY OF THE INVENTION

It is therefore an object of the present invention to provide a dipole antenna which provides an efficient (very little spurious radiation from its feeder arrangement) antenna on a high permitivity substrate.

Another object of the present invention is to provide a small dipole antenna which can incorporate active components and is compatible with MMIC technology.

According to the present invention, a miniature microstrip dipole antenna is constructed on a high permitivity dielectic substrate for compatibility with microwave monolithic integrated circuit (MMIC) technology. The antenna comprises two dipole arms coupled to opposite faces of the substrate. The dipole arms are coupled to a microstrip transmission line through a tapered balun. The tapered balun comprises two conductors on opposite faces of the substrate which are coupled to corresponding dipole arms. The conductors are separated laterally (with respect to the width of the face of the substrate) a calculated distance, and are gradually tapered. This allows the balun to efficiently transform unbalanced signals at the microstrip transmission line to balanced signals at the plurality of dipole arms. Alternatively, the balun allows balanced signals at the dipole arms to be efficiently transformed to unbalanced signals at the microstrip transmission line. To achieve additional radiation directivity, a ground plane is coupled to and parallel with a back face of the substrate. By using a high dielectric substrate, the cavity formed between the substrate and the ground plane is relatively very shallow.

The above and other objects, features, and advantages of the present invention will be better understood from the following detailed description taken in conjunction with the accompanying drawings.

DETAILED DESCRIPTION OF THE INVENTION

Dipole antennas are used to radiate controlled radio frequency energy from a microstrip transmission line formed on a dielectric substrate. Dipole antennas generally comprise two parallel dipole arms coupled by conductors to the microstrip transmission line.

The conducting lines for dipole antennas form baluns which are generally tapered to supply impedance transformation. The baluns transform the unbalanced impedance characteristics of the signals at the microstrip transmission line to balanced impedance characteristics at the dipole arms. Similarly, a balanced impedance at the dipole arms will be transformed through the baluns to an unbalanced impedance at the microstrip. The balanced impedance at the dipole arms results in equal currents on both dipoles and 180 degree phasing.

Figure 1:
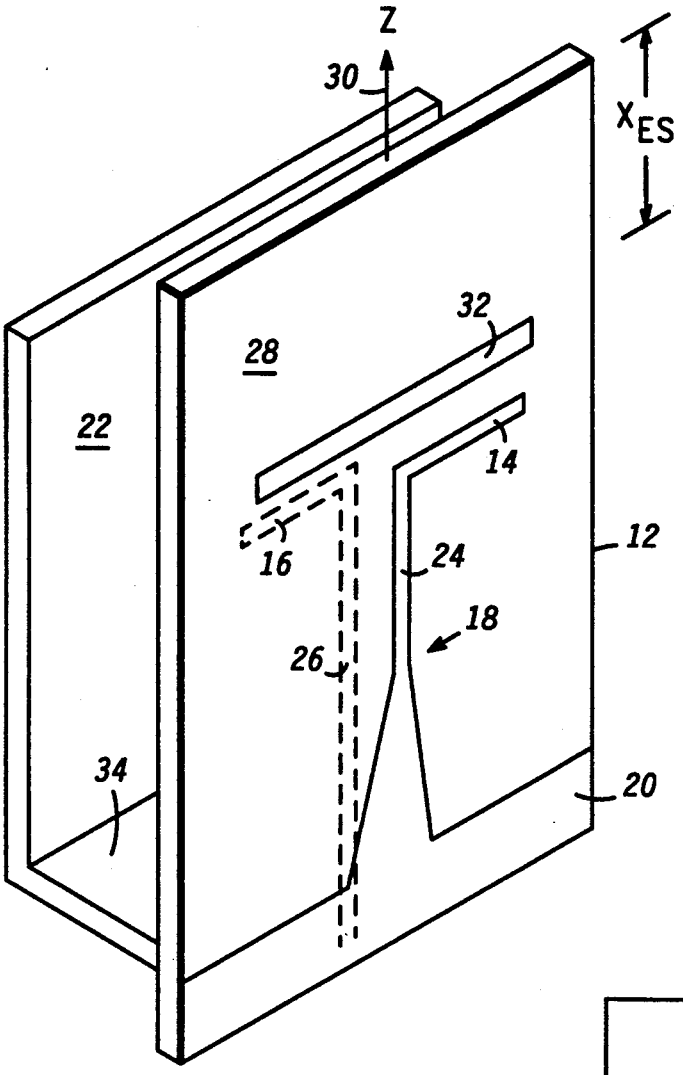
FIG. 1 is an isometric view of high permitivity microstrip dipole antenna according to the present invention.

FIG. 1 shows a microstrip dipole antenna 10 comprising high permitivity dielectric substrate 12, dipole arms 14 and 16, balun 18, microstrip transmission line 20, and ground plane 22.

Substrate 12 is preferably constructed of barium tetratitonate having a permitivity of approximately 38. Because of its high permitivity, substrate 12 is very thin compared with substrates having a low permitivity in the range of 2 to 5. The thickness of substrate 12 is approximately 0.0125 free-space wavelength. The high permitivity of substrate 12 supports end-fire surface-wave radiation even with the relatively small thickness.

Balun 18 comprises first conductor 24 and second conductor 26. In FIG. 1, first conductor 24 couples dipole arm 14 to transmission line 20. Second conductor 26 couples dipole arm 16 to the ground plane of transmission line 20. Dipole arm 14 and conductor 24 are coupled on face 28 of substrate 12. Dipole arm 16 and conductor 26 are constructed on an opposite face of substrate 12. First and second conductors 24 and 26 form an electric field which together provide impedance transformations from the unbalanced transmission line 20 to the balanced dipole arms 14 and 16. Microstrip-to-balanced line impedance transformation are performed by tapering first and second conductors 24 and 26. The design of the tapers are determined according to the method outlined in "A Transmission Line Taper of Improved Design", R. W. Klopfenstein, *Proceedings of the IRE*. January, 1956, pp. 31–35. As seen in FIG. 1, first conductor 24 is relatively broad where first conductor 24 couples with microstrip transmission line 20. First conductor 24 is tapered to a relatively narrow width near dipole arm 14. Second conductor 26 is substantially narrower than first conductor 24 near microstrip transmission line 20. Second conductor 26 tapers only slightly as it nears dipole arm 16.

The physical length of balun 18, and the extension length of dipole arms 14 and 16, are comparatively small due to the high permitivity of substrate 12. The extension lengths of dipole arms 14 and 16 are nearly only half as long as half-wave dipoles constructed on low dielectric substrates when barium tetratitonate is used in substrate 12. The lengths of dipole arms 14 and 16 approximate a quarter-wave length.

Figure 2:
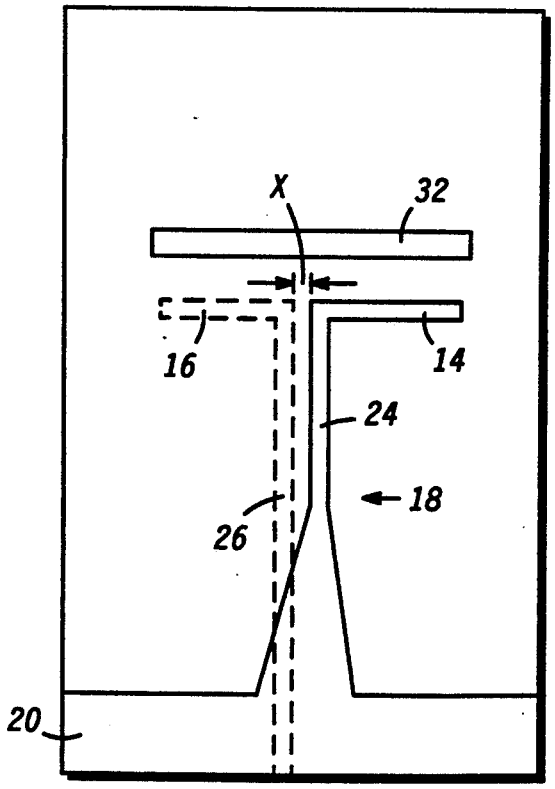
FIG. 2 is a front view of the high permitivity microstrip dipole antenna of FIG. 1.

Referring to FIG. 2, first conductor 24 overlaps second conductor 26 near microstrip transmission line 20. As balun 18 is tapered to dipole arms 14 and 16, conductors 24 and 26 separate until conductors 24 and 26, and similarly dipole arms 14 and 16, are separated a calculated distance X. The separation of conductors 24 and 26 at the dipole arms is required for efficient radiation when using a high permitivity substrate as used in substrate 12. The tapered design of balun 18 allows a gradual transition from an unbalanced impedence, where conductors 24 and 26 overlap, to a balanced impedence at dipole arms 14 and 16. The gradual transition effectively eliminates the radiation or ohmic loss prevalent in the Bawer and Wolfe Balun (which incorporates sharp corners in the conductor lines). Thus, since launching of controlled microwave radiation depends critically on the nature of the transmission mechanism from transmission line 20 to the radiating dipole arms 14 and 16, balun 18 results in a highly efficient launching device.

Referring again to FIG. 1, antenna 10, when comprised generally of dipole arms 14 and 16, balun 18 and microstrip 20, exhibits a radiation pattern with a peak gain of approximately 2.2 dBLI (decibels with respect to a linearly polarized isotropic radiator) along Z-axis 30. By increasing substrate 12 a distance of $X_{es}$, and by coupling a ground plane 22 underneath dipole arm 16, the peak gain of antenna 10 increases to 5 dBLI in a direction normal to face 28 of substrate 12. By further, coupling director 32 on face 28 of substrate 12 immediately above dipole arm 14, and by coupling reflector 34 to ground plane 22 and substrate 12, the peak gain of antenna 10 increases to 8 dBLI.

It will be recognized that ground plane 22 and reflector 34 are constructed of metallic conducting material.

The high permitivity of substrate 12 allows ground plane 22 to be coupled closer to substrate 12 than otherwise possible for efficient radiation in cavity backed antennas. For example, assume antenna 10 comprises 6 $GH_z$ dipole arms 14 and 16 on substrate 12 having 0.025 inches of barium tetratitonate. Antenna 10 will produce 5 dBLI of peak gain when dipole arm 16 is located only one-eighth of a free-space wavelength from ground plane 22.

Thus, there has been provided in accordance with the present invention, a high permitivity dielectric microstrip dipole antenna that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as followed in the spirit and broad scope of the appended claims.

What is claimed is:

1. A microstrip dipole antenna comprising:

high permitivity dielectric substrate means for supplying a thin antenna substrate, said high dielectric substrate means including a front and a back face;

a plurality of radiating dipole arm means for radiating and receiving electromagnetic signals;

one each of said plurality of radiating dipole arm means coupled to one each of said front and back faces of said high permitivity dielectric substrate means;

microstrip transmission line means coupled to said high permitivity dielectric substrate means;

tapered balun means for supplying unbalanced signals from said microstrip transmission line means to said plurality of radiating dipole means by transforming said unbalanced signals to balanced signals, and said balanced signals to said unbalanced signals;

ground plane means coupled to, and parallel with, said back face of said high dielectric substrate means;

said ground plane means and said back face of said high dielectric substrate means defining a shallow cavity; and reflector means coupled between and perpendicular to, said ground plane means and said back face of said high dielectric substrate means.

2. A microstrip dipole antenna according to claim 1 wherein said tapered balun means comprises:

a plurality of conductors;

one each of said plurality of conductors coupled to one each of said front and back faces of said high dielectric substrate means;

said plurality of conductors separated by a calculated distance with respect to the width of said front face of said high dielectric substrate means; and each of said plurality of conductors gradually tapered to supply an efficient transformation of unbalanced to balanced and balanced to unbalanced, signals.

3. A microstrip dipole antenna according to claim 1 wherein the antenna further comprises:

at least one microstrip reflector means for directionally reflecting said radiated signals; and said at least one microstrip reflector means coupled to at least one of said front and back faces of said high dielectric substrate means.

* * * * *